US010215039B2

(12) United States Patent
Schiavo

(10) Patent No.: US 10,215,039 B2
(45) Date of Patent: Feb. 26, 2019

(54) DUCTING ARRANGEMENT WITH A CERAMIC LINER FOR DELIVERING HOT-TEMPERATURE GASES IN A COMBUSTION TURBINE ENGINE

(71) Applicant: Siemens Energy, Inc., Orlando, FL (US)

(72) Inventor: Anthony L. Schiavo, Oviedo, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 407 days.

(21) Appl. No.: 15/207,716

(22) Filed: Jul. 12, 2016

(65) Prior Publication Data

US 2018/0016921 A1 Jan. 18, 2018

(51) Int. Cl.

| | |
|---|---|
| ***F01D 9/02*** | (2006.01) |
| ***F23R 3/42*** | (2006.01) |
| ***F23R 3/60*** | (2006.01) |
| ***F23R 3/00*** | (2006.01) |

(52) U.S. Cl.

CPC ..... *F01D 9/023* (2013.01); *F23R 3/007* (2013.01); *F23R 3/425* (2013.01); *F23R 3/60* (2013.01); *F05D 2240/40* (2013.01); *F05D 2250/141* (2013.01); *F23R 2900/00005* (2013.01)

(58) Field of Classification Search

CPC ..... F01D 9/023

See application file for complete search history.

(56) References Cited

U.S. PATENT DOCUMENTS

| | | | | |
|---|---|---|---|---|
| 6,216,442 | B1 * | 4/2001 | Belsom | F02C 7/20 60/752 |
| 6,279,313 | B1 * | 8/2001 | Lawen, Jr. | F23R 3/46 60/752 |
| 6,331,110 | B1 * | 12/2001 | Steber | F01D 9/023 431/10 |
| 7,237,389 | B2 | 7/2007 | Ryan et al. | |
| 7,546,743 | B2 | 6/2009 | Bulman | |
| 7,908,867 | B2 | 3/2011 | Keller et al. | |
| 8,122,727 | B2 | 2/2012 | Shi et al. | |
| 8,276,389 | B2 | 10/2012 | Charron et al. | |
| 8,784,044 | B2 | 7/2014 | Durocher et al. | |
| 8,863,528 | B2 | 7/2014 | Shi et al. | |
| 8,955,330 | B2 | 2/2015 | Narcus et al. | |
| 9,127,565 | B2 | 9/2015 | Keller et al. | |
| 9,157,638 | B2 * | 10/2015 | Ponziani | F23R 3/60 |
| 9,416,969 | B2 * | 8/2016 | Weaver | F23R 3/00 |
| 2007/0130958 | A1 * | 6/2007 | Ohri | F23R 3/60 60/796 |

(Continued)

*Primary Examiner* — Craig Kim

(57) ABSTRACT

A ducting arrangement (12) for a combustion turbine engine is provided. The arrangement includes a ceramic liner (22) defining a hot gas path throughout a length of the ducting arrangement. A cooling sleeve (24) is disposed circumferentially outwardly onto the ceramic liner along the length. A metallic support frame (26) is disposed circumferentially outwardly onto the cooling sleeve along the length. The cooling sleeve may be structured with structural features along the length for biasing against the ceramic liner and the metallic support frame to resiliently accept mechanical and thermal growth induced loading that develops between the ceramic liner and the metallic support frame during operating conditions of the combustion turbine engine.

20 Claims, 12 Drawing Sheets

(56) References Cited

U.S. PATENT DOCUMENTS

| | | | | |
|---|---|---|---|---|
| 2009/0120093 | A1* | 5/2009 | Johnson | F01D 9/023 60/752 |
| 2011/0120135 | A1* | 5/2011 | Johnson | F01D 9/023 60/772 |
| 2012/0006518 | A1* | 1/2012 | Lee | F23R 3/005 165/168 |
| 2014/0260275 | A1* | 9/2014 | Melton | F01D 9/023 60/740 |
| 2014/0260277 | A1* | 9/2014 | DiCintio | F23R 3/005 60/746 |

* cited by examiner

DUCTING ARRANGEMENT WITH A CERAMIC LINER FOR DELIVERING HOT-TEMPERATURE GASES IN A COMBUSTION TURBINE ENGINE

STATEMENT REGARDING FEDERALLY SPONSORED DEVELOPMENT

Development for this invention was supported in part by Contract No. DE-FE0023955, awarded by the United States Department of Energy. Accordingly, the United States Government may have certain rights in this invention.

FIELD OF THE INVENTION

Disclosed embodiments relate in general to a combustion turbine engine, such as a gas turbine engine, and, more particularly, to a ducting arrangement with a ceramic liner in the combustor section of the engine.

BACKGROUND OF THE INVENTION

Disclosed embodiments may be used in applications involving a ducting arrangement configured so that a first stage of stationary airfoils (vanes) in the turbine section of the engine is eliminated, and where the hot working gases exiting the transition duct are conveyed directly to a row of rotating airfoils (blades) with high tangential velocity. In such cases, the ducting arrangement accomplishes the task of redirecting the gases, which would otherwise have been accomplished by a first row of turbine vanes. One example of a ducting arrangement having such a configuration is described in U.S. Pat. No. 8,276,389, which is incorporated herein by reference in its entirety. It will be appreciated that disclosed embodiments are not limited to such applications.

BRIEF DESCRIPTION OF THE DRAWINGS

The invention is explained in the following description in view of the drawings that show.

DETAILED DESCRIPTION OF THE INVENTION

Figure 1:
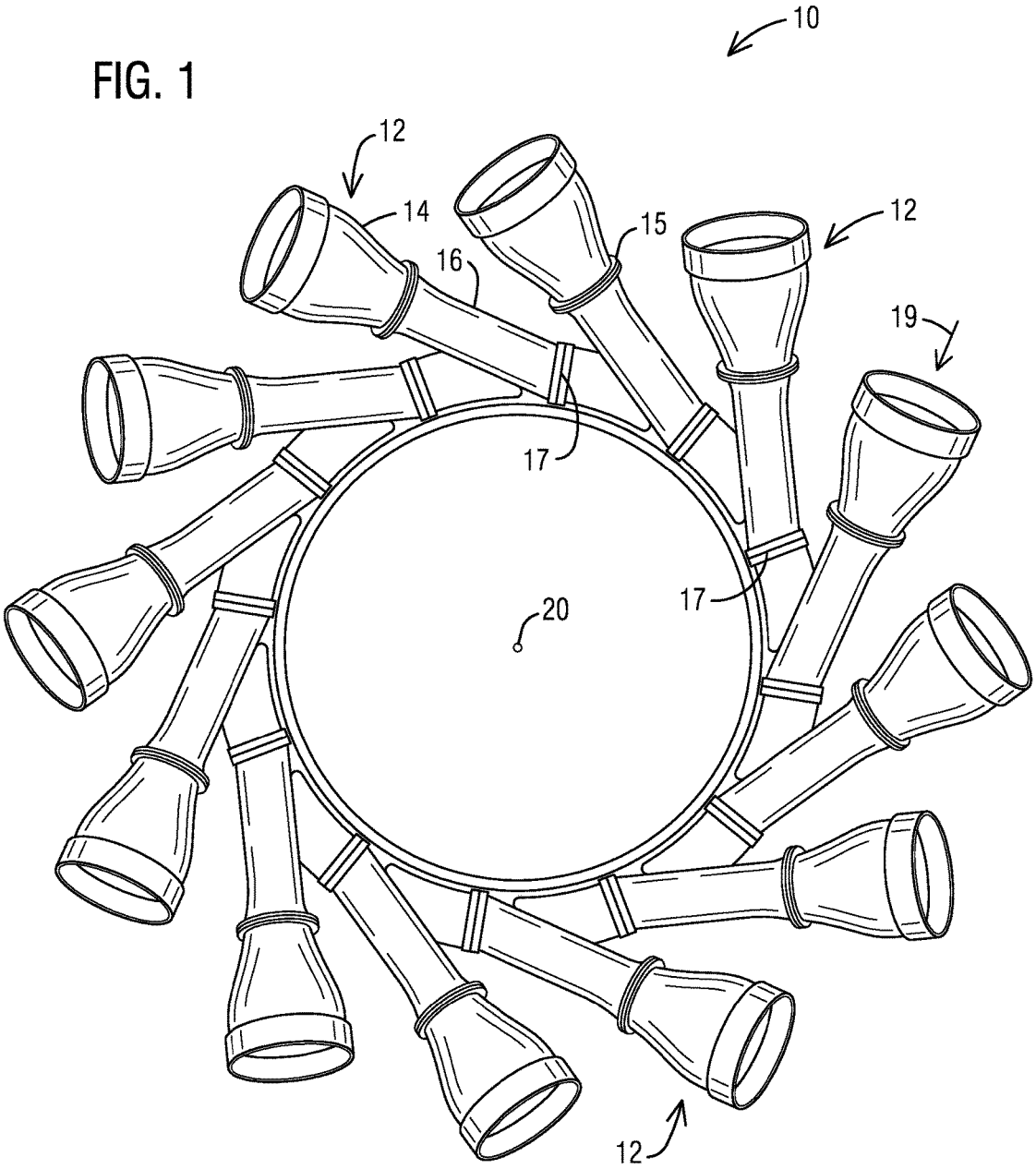
FIG. 1 is an upstream view of one non-limiting embodiment of a transition duct system that may benefit from disclosed ducting arrangements. The system may be used for delivering hot-temperature gases from a plurality of combustors in a combustion turbine engine to a first row of turbine blades in the combustion turbine engine.

The present inventor has recognized that certain known transition duct arrangements tend to consume a substantial amount of cooling air in view of the hot-temperature gases directed by such a system. This can reduce the efficiency of the gas turbine engine and can lead to increased generation of NOx emissions. In view of such a recognition, the present inventor proposes innovative structural arrangements in a ducting arrangement that in a reliable and cost-effective manner can be used to securely attach a thermal insulating liner, such as may comprise a suitable ceramic, in the presence of a substantial flow path pressurization, as may develop in the high Mach (M) number regions of the system (e.g., approaching approximately 0.8 M). Moreover, the proposed structural arrangement is designed to accommodate thermal growth differences that may develop between the thermal insulating liner and a metallic support frame. Lastly, the proposed ducting arrangement is designed to improve cost-effective serviceability of the ducting arrangement since disclosed thermal insulating liners can be readily removed and replaced as needed.

In the following detailed description, various specific details are set forth in order to provide a thorough understanding of such embodiments. However, those skilled in the art will understand that embodiments of the present invention may be practiced without these specific details, that the present invention is not limited to the depicted embodiments, and that the present invention may be practiced in a variety of alternative embodiments. In other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that they are even order dependent, unless otherwise indicated. Moreover, repeated usage of the phrase "in one embodiment" does not necessarily refer to the same embodiment, although it may. It is noted that disclosed embodiments need not be construed as mutually exclusive embodiments, since aspects of such disclosed embodiments may be appropriately combined by one skilled in the art depending on the needs of a given application.

The terms "comprising", "including", "having", and the like, as used in the present application, are intended to be synonymous unless otherwise indicated. Lastly, as used herein, the phrases "configured to" or "arranged to" embrace the concept that the feature preceding the phrases "configured to" or "arranged to" is intentionally and specifically designed or made to act or function in a specific way and should not be construed to mean that the feature just has a capability or suitability to act or function in the specified way, unless so indicated.

FIG. 1 is an upstream view of one non-limiting embodiment of a transition duct system 10 that may benefit from disclosed ducting arrangements. Transition duct system 10 may be used for delivering hot-temperature gases from a plurality of combustors (not shown) in a combustion turbine engine to a first row of turbine blades in the combustion turbine engine. As referred to herein, an upstream view means looking from upstream toward downstream along a longitudinal axis 20 of the gas turbine engine, and a downstream view, as shown in FIG. 2, means the opposite.

Figure 2:
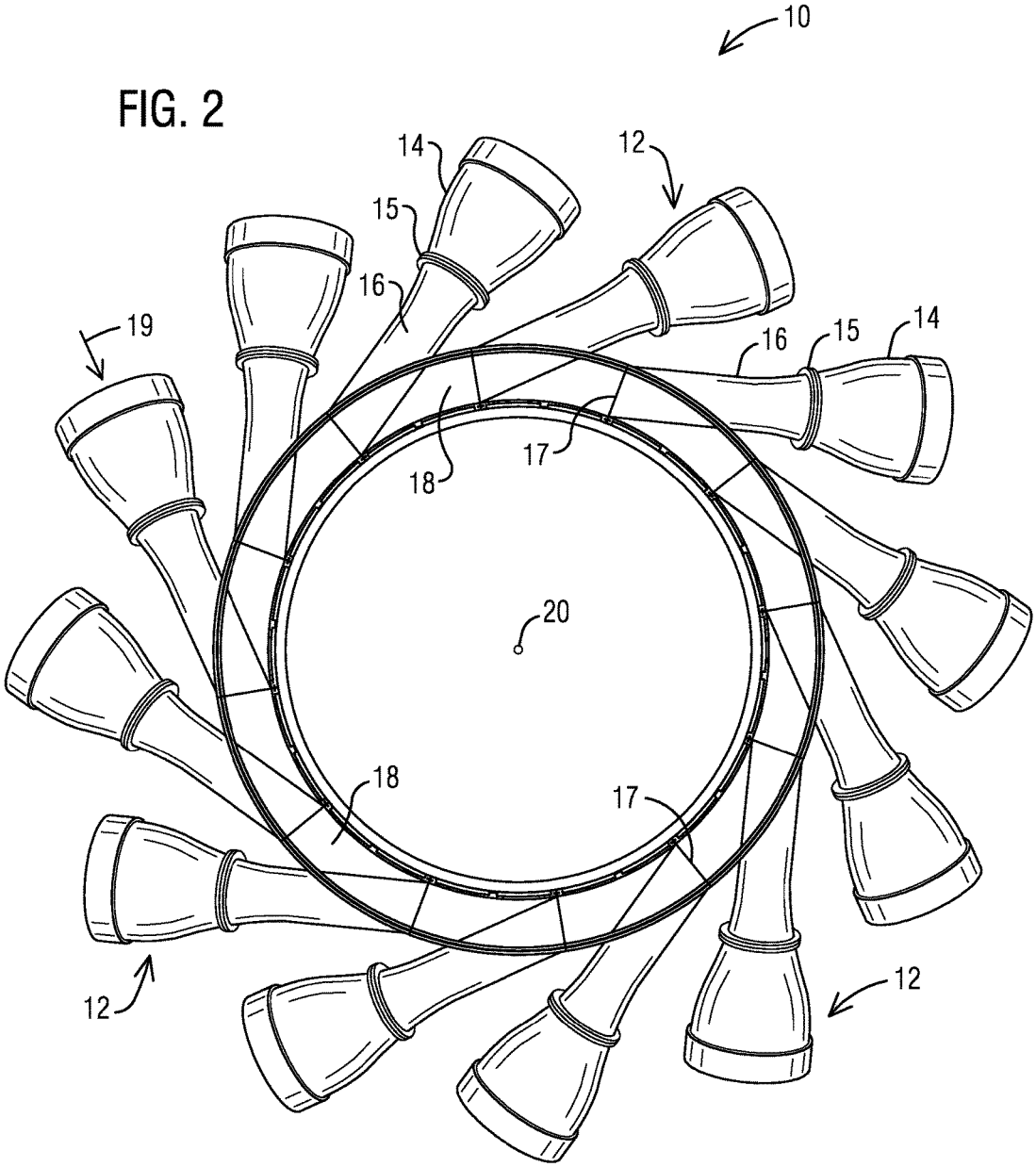
FIG. 2 is a downstream view of the transition duct system shown in FIG. 1.

As can be appreciated in FIGS. 1 and 2, transition duct system 10 is composed of multiple sets of flow directing structures, each forming a ducting arrangement 12. There is a ducting arrangement 12 for each combustor. Combustion gases flow from each combustor into a respective ducting arrangement 12. In one non-limiting embodiment, each ducting arrangement 12 may include a flow-accelerating cone 14 and an exit piece 16 that may be joined to one another at an interface 15. The exit pieces 16 in combination form an annular chamber 18, which is illustrated in FIG. 2.

Each gas flow from a respective exit piece 16 enters annular chamber 18 at respective circumferential locations. Each gas flow originates in its respective combustor can and is directed as a discrete flow to the annular chamber 18. Each exit piece 16 abuts adjacent annular chamber ends at exit piece joints 17. Annular chamber 18 is arranged to extend circumferentially and oriented concentric to longitudinal axis 20 for delivering the gas flow to the first row of blades (not shown), which would be disposed immediately downstream of annular chamber 18.

Figure 3:
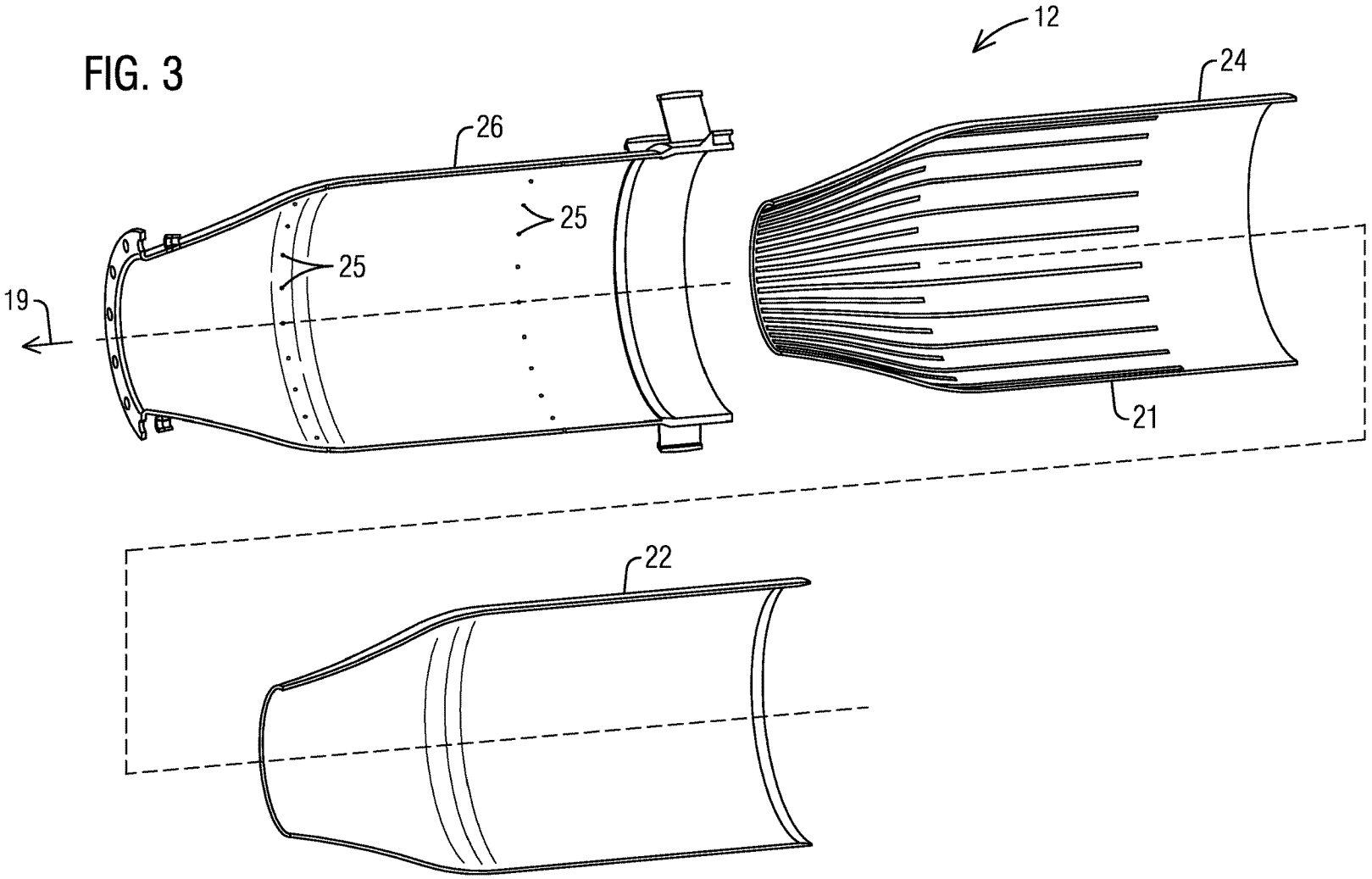
FIG. 3 is an exploded, fragmentary view of a disclosed ducting arrangement including a thermal insulating liner, such as a ceramic liner, a cooling sleeve and a metallic support frame.

FIG. 3 is an exploded, fragmentary view of a disclosed ducting arrangement 12, as may include a thermal insulating liner 22 defining a hot gas path throughout a length of the ducting arrangement. The longitudinal axis of the ducting arrangement is schematically represented by arrow 19. Without limitation, thermal insulating liner 22 may be a structure such as a ceramic, a ceramic matrix composite, a high temperature alloy with a thermal barrier coating, etc.

Figure 4:
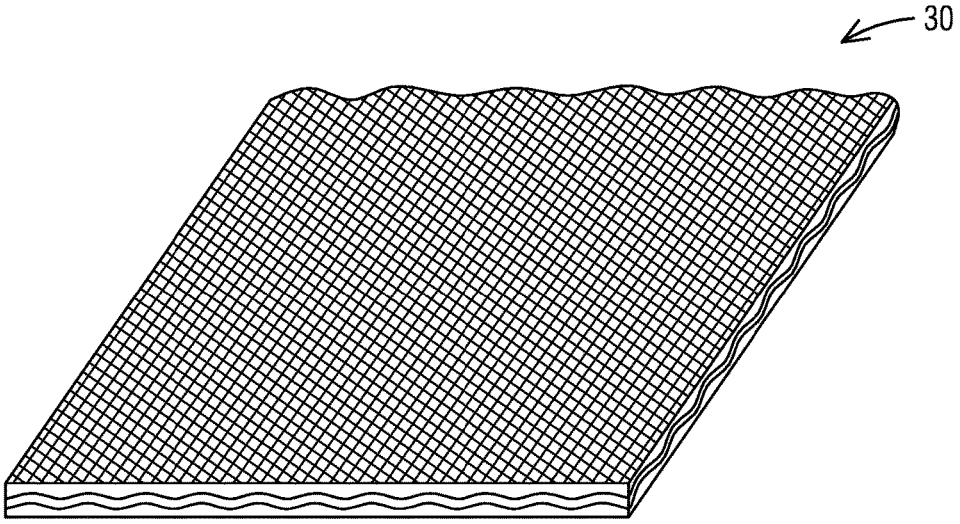
FIG. 4 is an isometric view of a cooling sleeve as may comprise a mesh sheet structure.
Figure 5:
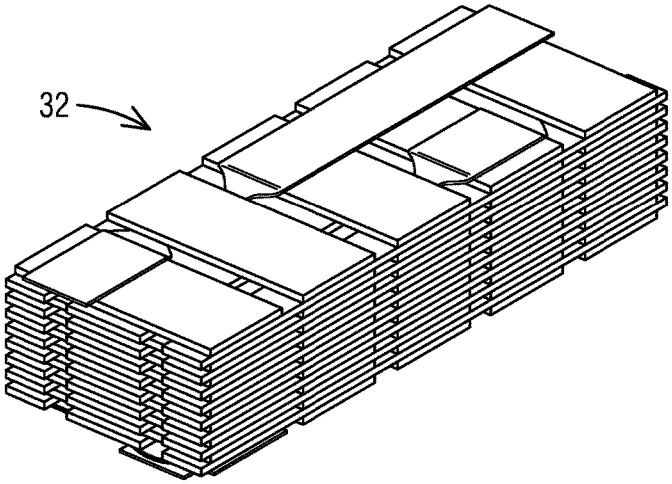
FIG. 5 is an isometric view of a cooling sleeve, as may comprise a woven mesh structure.

A cooling sleeve 24 is disposed circumferentially outwardly onto thermal insulating liner 22 along the length of the ducting arrangement. Cooling sleeve 24 may be a structure such as a metallic sheet structure comprising a high temperature super alloy, such as without limitation Hastelloy® X alloy, Inconel® X alloy, Haynes® 282, etc. In certain alternative embodiments, cooling sleeve 24 may be a mesh sheet structure 30, as shown in FIG. 4, or a woven mesh structure, such as without limitation a three-dimensional woven mesh 32, as shown in FIG. 5.

A metallic support frame 26 is disposed circumferentially outwardly onto cooling sleeve 24 along the length of the ducting arrangement. Metallic support frame 26, like cooling sleeve 24, may also (but need not) be made of a high temperature super alloy. In one non-limiting embodiment, cooling sleeve 24 is structured along the length with means for biasing (e.g., spring biasing) against thermal insulating liner 22 and metallic support frame 26 to resiliently accept mechanical and thermal growth induced loading that develops between thermal insulating liner 22 and metallic support frame 26 during operating conditions of the combustion turbine engine.

Figure 6:
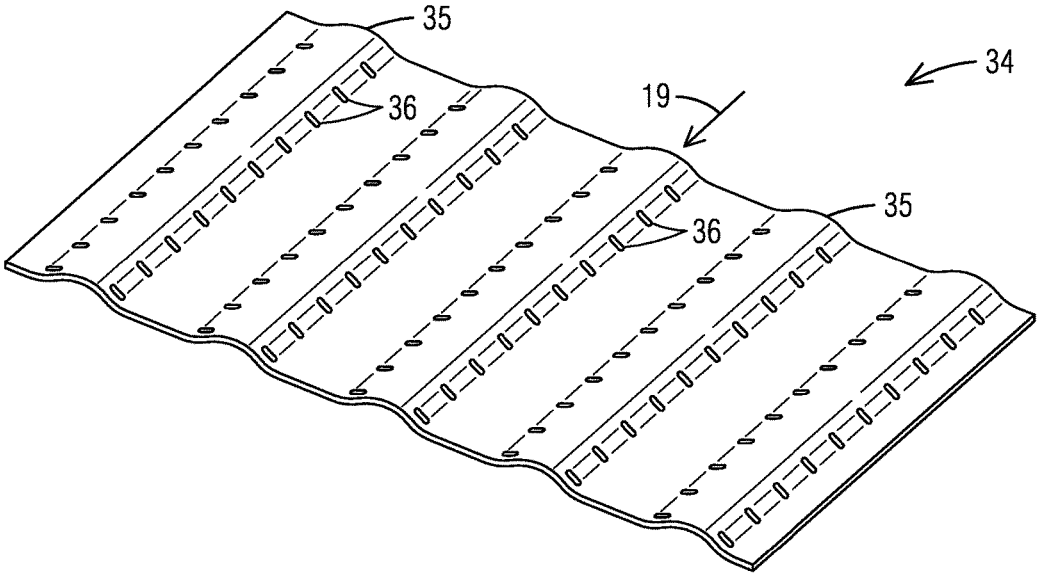
FIGS. 6-11 are respective isometric views of surface features that may be constructed on the cooling sleeve for spring biasing against the ceramic liner and the metallic support frame.
Figure 7:
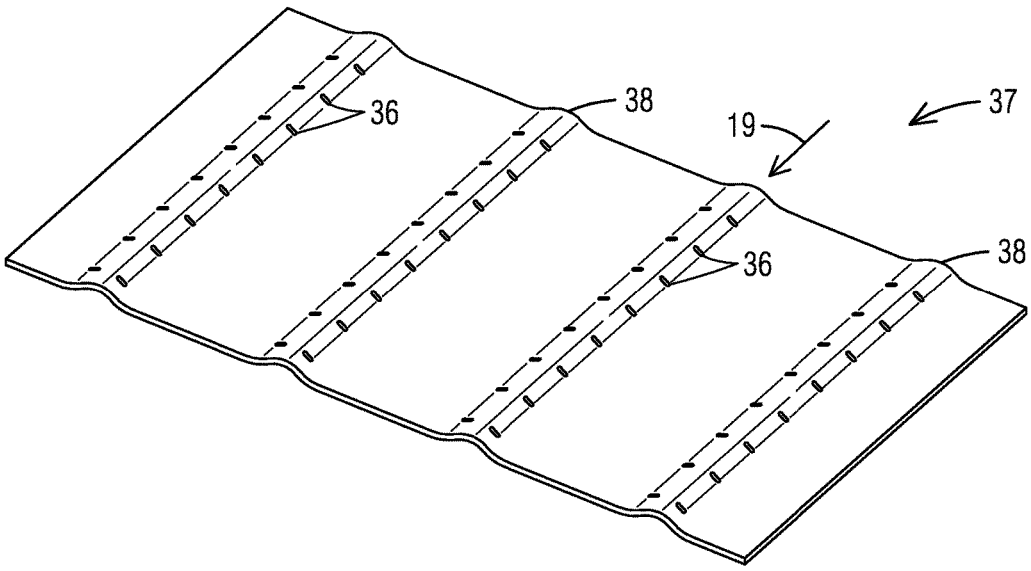
Figure 8:
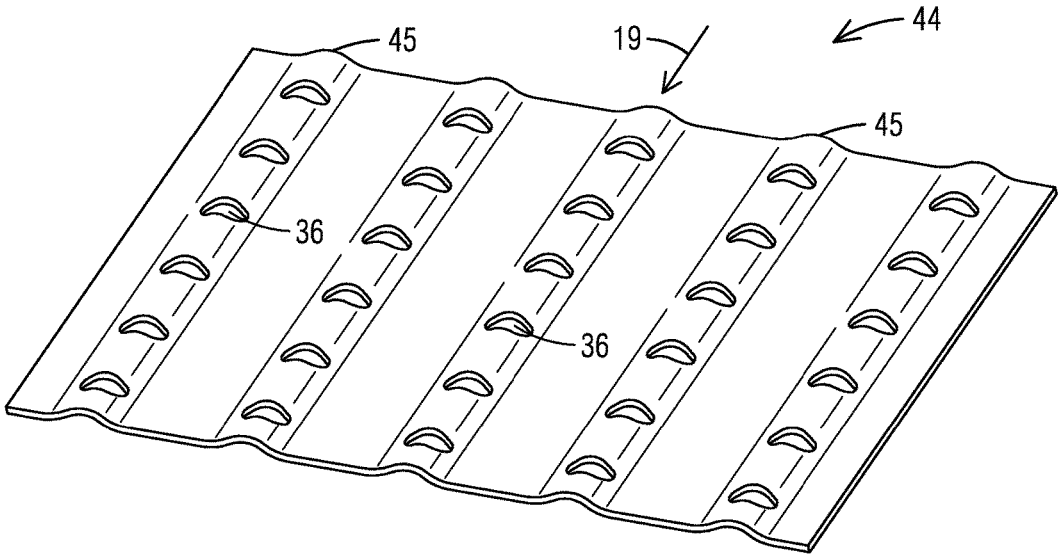
Figure 9:
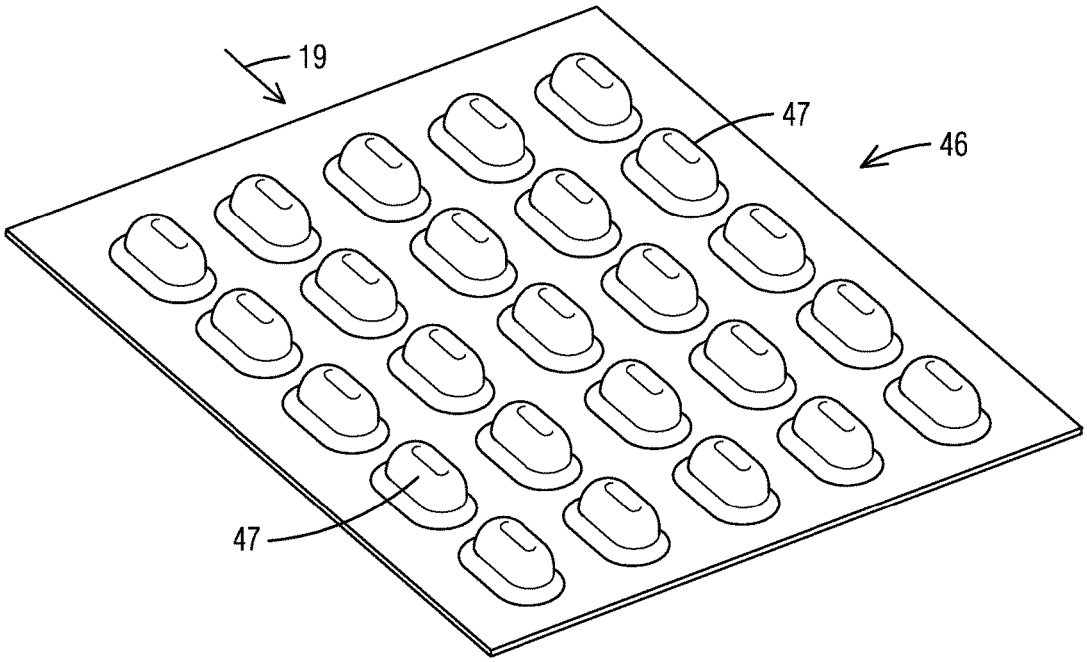
Figure 10:
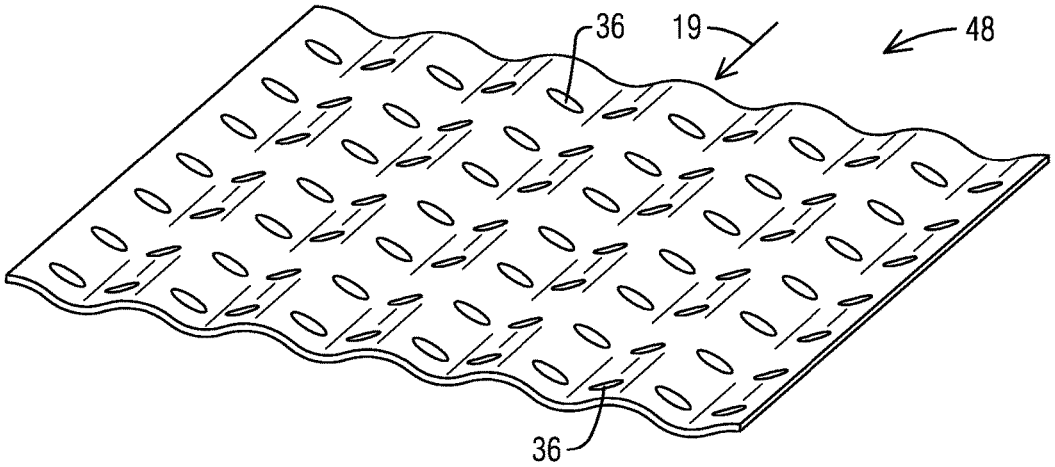
Figure 11:
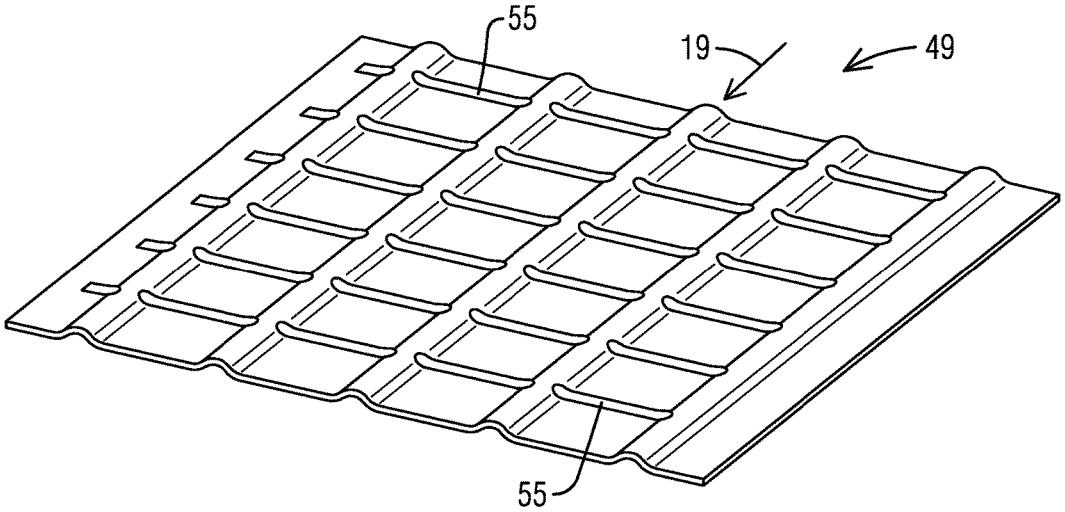

In embodiments where cooling sleeve 24 comprises a metallic sheet structure, one or more surfaces of the metallic sheet structure of the cooling sleeve may include features that constitute the means for biasing against the ceramic liner and the metallic support frame, such as without limitation, a wave spring 34, as shown in FIG. 6, that may be formed with elastically deformable crests 35 (e.g., cooperating to form a compliant wave spring) that may include cooling orifices 36 positioned near respective crest bases; a wave spring 37, as shown in FIG. 7, that may be formed with relatively narrower (e.g., stiffer) crests 38 (e.g., cooperating to form a relatively stiff wave spring) that may also include cooling orifices 36, (thus, it will be appreciated that such wave springs may be appropriately configured to have a desired spring constant depending on the needs of a given application); a wave spring 44, as shown in FIG. 8, with cooling orifices 36 constructed at the respective crests 45 of wave spring 44, (i.e., forming a segmented or articulated wave spring in lieu of a continuous wave spring, as illustrated in FIGS. 6 and 7); a sheet structure 46 with a plurality of dimples 47 that may additionally function as respective turbulators (it will be appreciated that such dimples need not be arranged in a fixed, repetitive pattern since such features may be spatially offset relative to one another (e.g., staggered); a sinusoidal wave spring 48 including cooling orifices 36, as shown in FIG. 10; and a wave spring 49 including transversely-extending (e.g., transverse relative to longitudinal axis 19) cooling slots 55 in lieu of cooling orifices, as shown in FIG. 11, and a combination of two or more of the above-described features. It will be appreciated that the foregoing structural features should not be construed in a limiting sense since such structural features may be tailored in a variety of ways to achieve structures for biasing against the ceramic liner and the metallic support frame to resiliently accept mechanical and thermal growth induced loading that develops between the ceramic liner and the metallic support frame during operating conditions of the combustion turbine engine.

In embodiments where cooling sleeve 24 comprises a mesh sheet structure or a woven mesh structure, a respective spring constant of the mesh structure or the woven mesh structure can be used to characterize the means for biasing against the ceramic liner and the metallic support frame. Without limiting aspects to any particular theory of operation, this would allow such structures to provide an appropriate distribution of compression against the ceramic liner and the metallic support frame.

Figure 12:
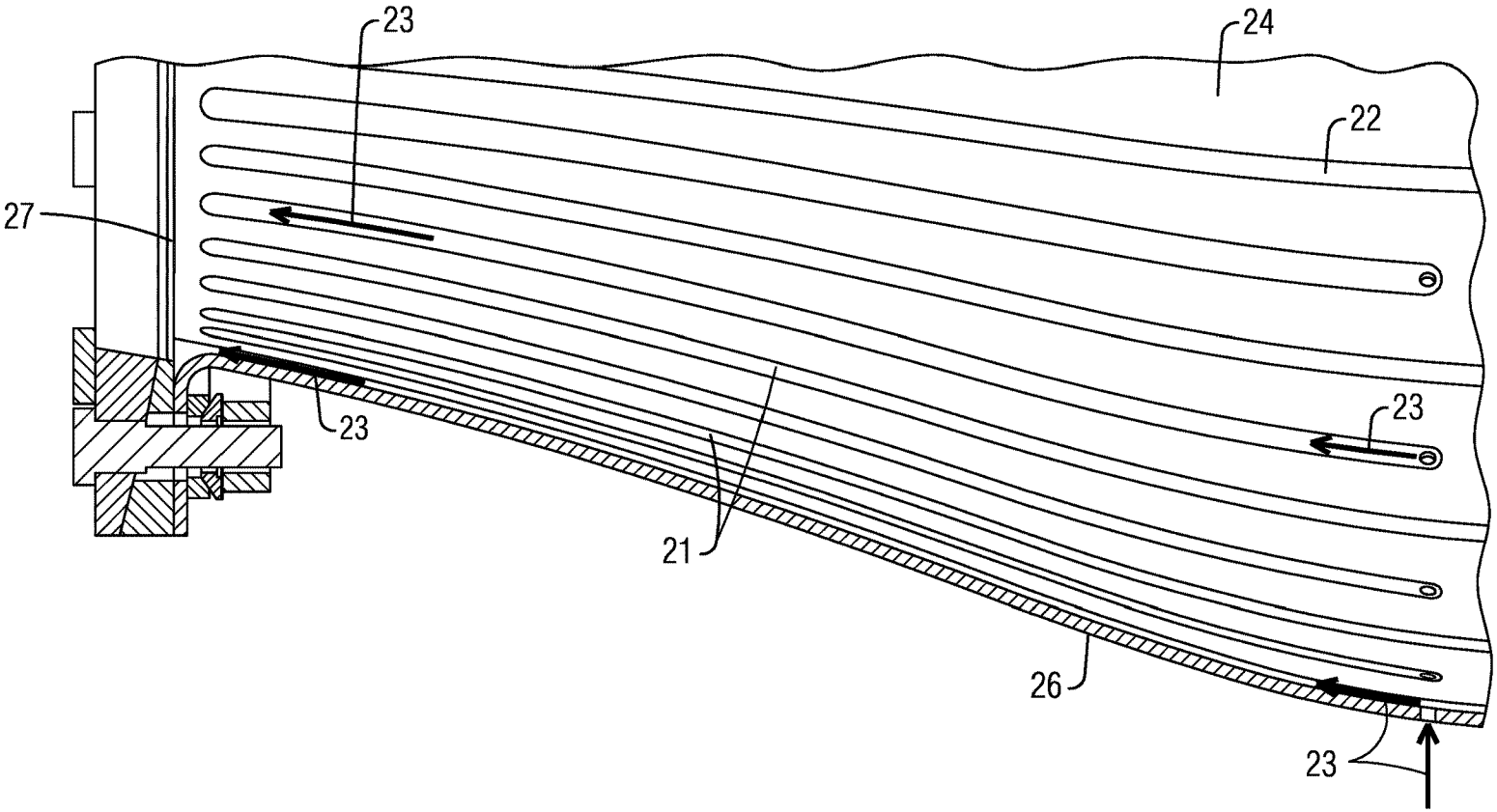
FIG. 12 is an isometric, fragmentary view showing slits that may be constructed in the cooling sleeve for conveying cooling air to the ceramic liner and the metallic support frame.
Figure 18:
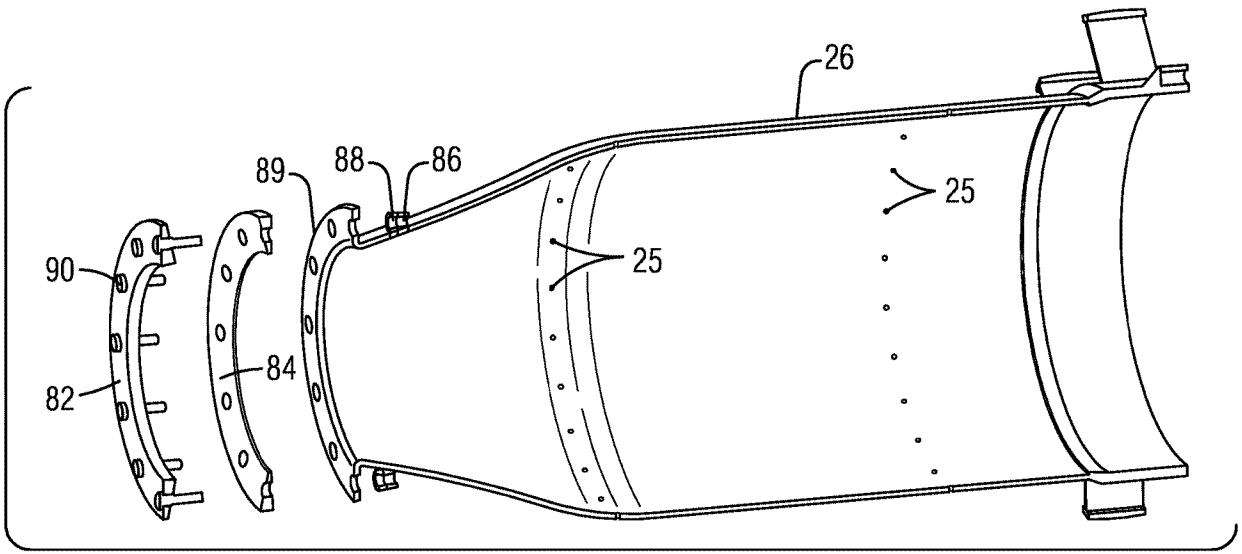
FIG. 18 is an exploded, fragmentary view in connection with certain elements involved with the affixing connection at the downstream side of the ducting arrangement.

In embodiments where cooling sleeve 24 comprises a metallic sheet structure, as shown in FIG. 12, a number of slits 21 may be appropriately arranged in cooling sleeve 24, such as extending lengthwise or otherwise throughout the ducting arrangement to convey cooling air (schematically represented by arrows 23) to ceramic liner 22 and metallic support frame 26. In one non limiting embodiment, one or more gaps 27 may be constructed at the downstream side of the ducting arrangement, such as at the interface 15 between flow-accelerating cone 14 and exit piece 16 (FIG. 1), to allow exhaust of the cooling air while reducing the possibility of hot gas entrainment in gaps 27 at the interface 15. As shown in FIGS. 3 and 18, metallic support frame 26 includes respective cooling air inlet orifices 25 that may be arranged in correspondence with respective ones of the slits 21 in cooling sleeve 24 to convey the cooling air.

Alternatively, in embodiments where the cooling sleeve comprises a mesh sheet structure or woven mesh structure, such structures may be constructed with an appropriate level of structural porosity (e.g., porous matrix structure), and in this case the cooling air inlet orifices can be in fluid communication with the mesh structure or the woven mesh structure to convey cooling air though such porous matrixes and thus extract heat from ceramic liner 22 and metallic support frame 26.

Figure 13:
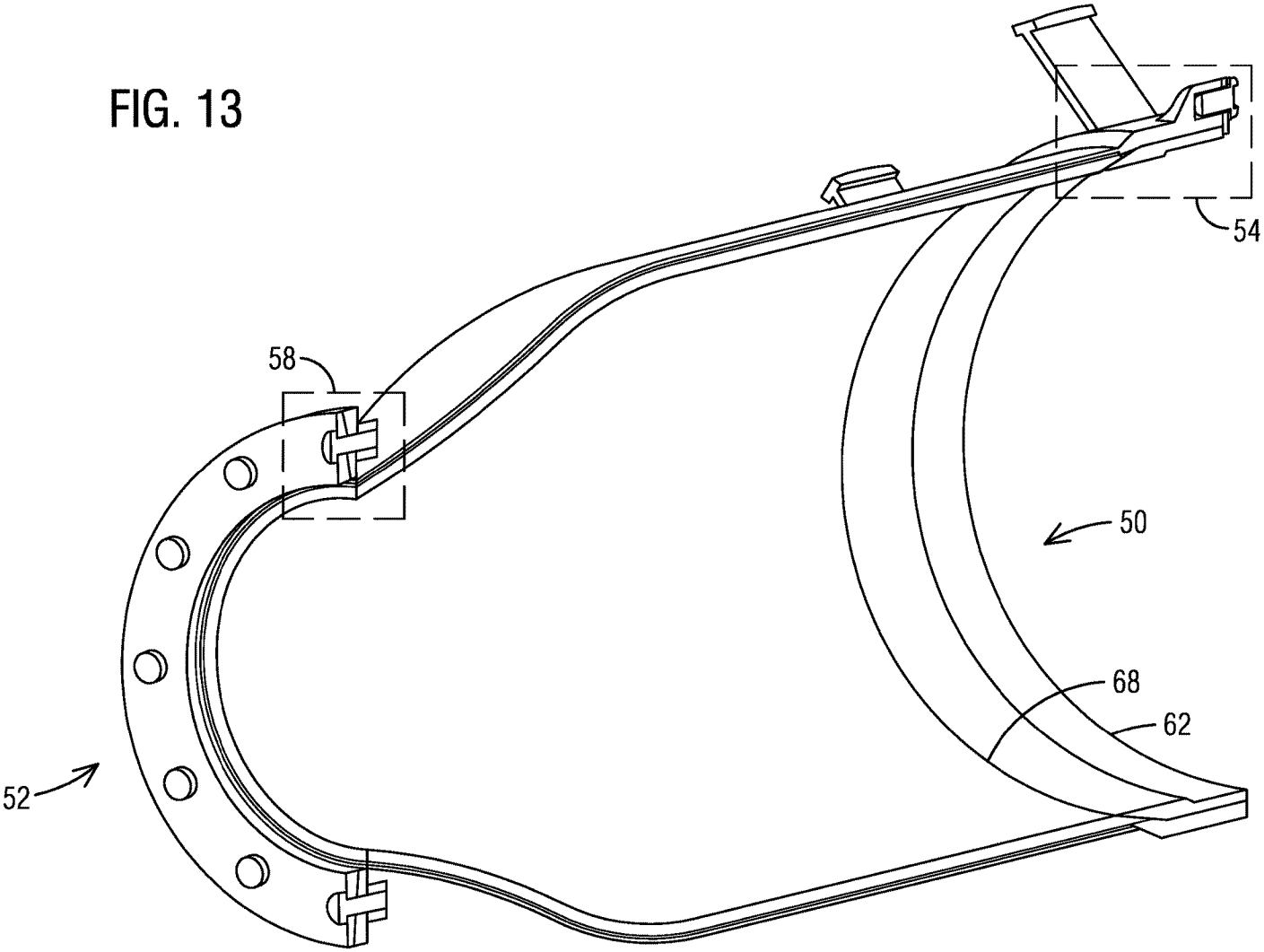
FIG. 13 is an isometric, fragmentary view of a disclosed ducting arrangement illustrating a respective affixing connection at an upstream side of the ducting arrangement, and a respective affixing connection at a downstream side of the ducting arrangement

FIG. 13 is an isometric, fragmentary view illustrating a respective affixing connection 50 at an upstream side of the ducting arrangement and a respective affixing connection 52 at a downstream side of the ducting arrangement. Details regarding affixing connections 50, 52 are elaborated in greater detail below.

Figure 14:
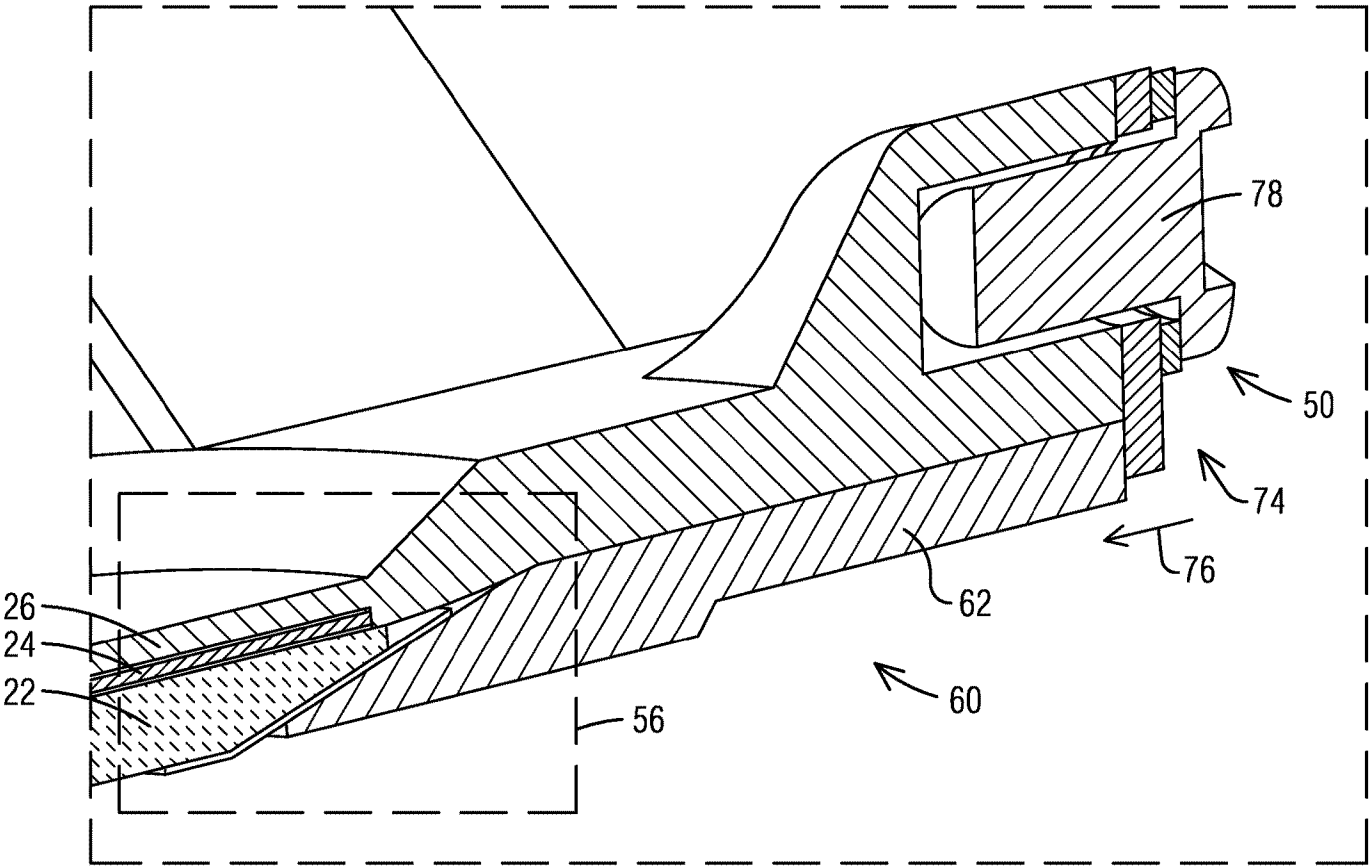
FIGS. 14 and 15 are isometric, fragmentary views respectively zooming-in on structural details regarding the upstream affixing connection of the ducting arrangement, illustrated in FIG. 13.
Figure 15:
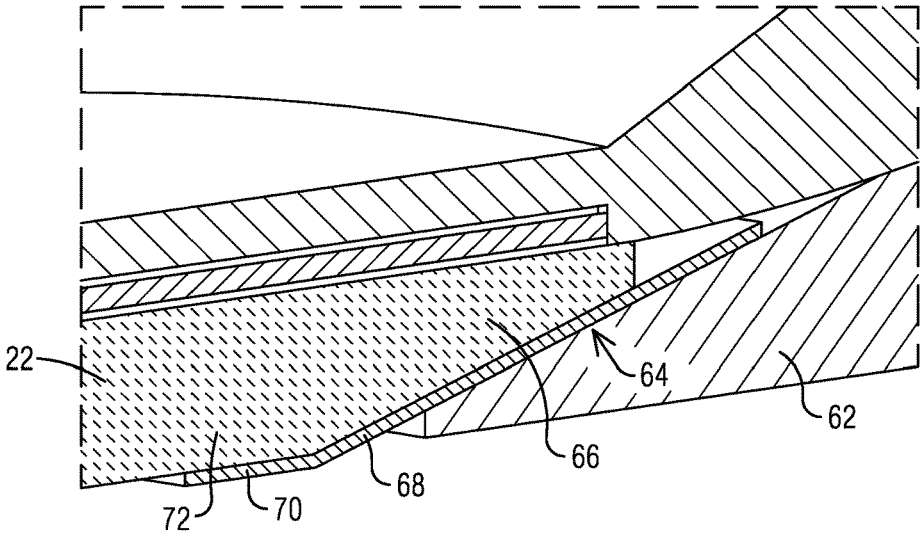
Figure 16:
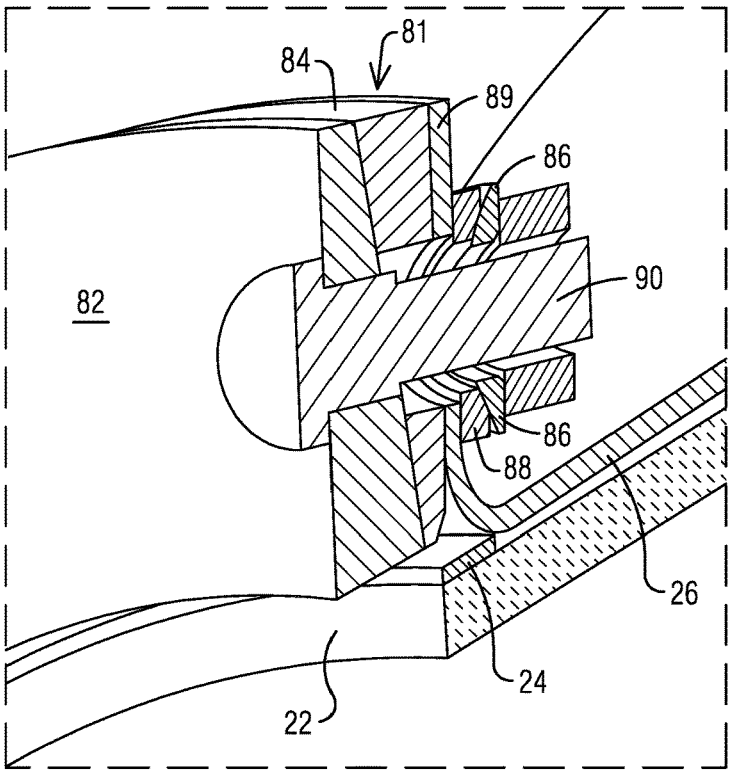
FIG. 16 is an isometric, fragmentary view zooming-in on structural details regarding the downstream affixing connection of the ducting arrangement, illustrated in FIG. 13.

More specifically, FIG. 14 is an isometric, fragmentary view zooming-in on structural details within an inset 54 shown in FIG. 13; FIG. 15 is an isometric, fragmentary view further zooming-in on structural details within an inset 56 shown in FIG. 14; and FIG. 16 is an isometric, fragmentary view zooming-in on graphical details within an inset 58 shown in FIG. 13. It will be appreciated that FIGS. 14 and 15 is each directed to details regarding affixing connection 50 at the upstream side of the ducting arrangement and FIG. 14 is directed to details regarding affixing connection 52 at the downstream side of the ducting arrangement.

In one non-limiting embodiment, a disclosed ducting arrangement includes interference fit means 60 (FIG. 14) for affixing to one another ceramic liner 22, cooling sleeve 24 and metallic support frame 26 at upstream side 50 of the ducting arrangement. In one non-limiting embodiment, as may be better appreciated in FIG. 15, interference fit means 60 comprises a clamping ring 62 including an end segment 64 with a tapering profile in correspondence with an opposed tapering profile at an end segment 66 of ceramic liner 22.

Interference fit means 60 further comprises a liner protective ring 68 interposed between the corresponding end segments 64, 66 of clamping ring 62 and ceramic liner 22. Liner protective ring 68 may include an appendage 70 to engage a segment 72 of ceramic liner 22 axially extending downstream from end segment 66 of ceramic liner 22.

Figure 17:
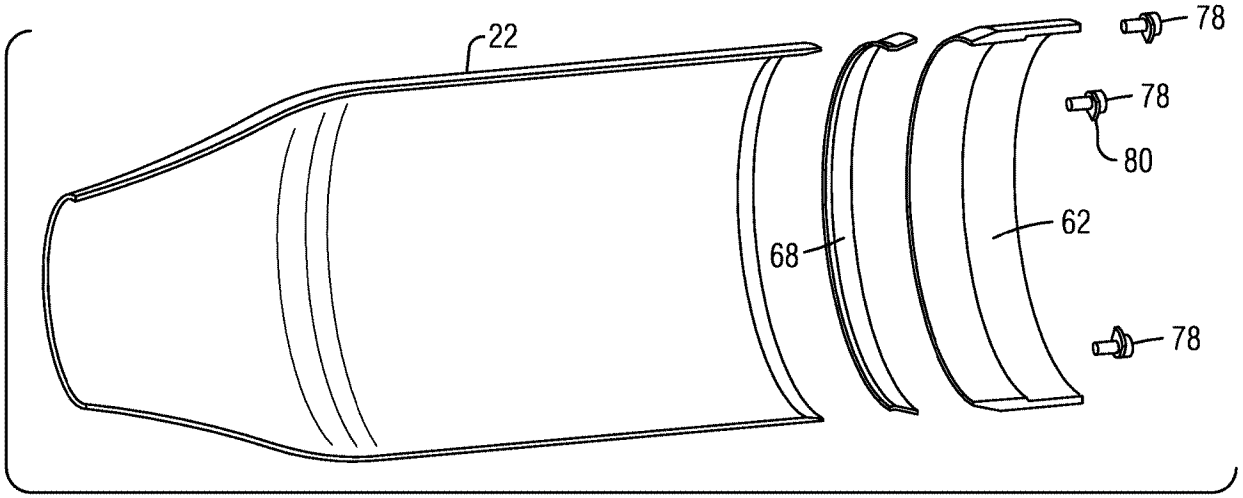
FIG. 17 is an exploded, fragmentary view in connection with certain elements involved with the affixing connection at the upstream side of the ducting arrangement.

In one non-limiting embodiment, clamping ring 62 may be responsive to a positioning assembly 74 (e.g., bolting action applied by way of circumferentially arranged bolts 78, see also FIG. 17) configured to cause downstream axial movement (schematically represented by arrow 76 in FIG. 14) of clamping ring 62 relative to ceramic liner 22 so that the corresponding tapering profiles of clamping ring 62 and ceramic liner 22 engage to define an interference fit between one another. This arrangement is effective to protect the upstream end of ceramic liner 22 (e.g., enabling a relatively uniform pressure or interference fit). Bolts 78 may include a locking tab 80 (FIG. 17) to lock components of the ducting arrangement for installation into a respective transition duct system. It will be appreciated that this arrangement facilitates user-friendly and cost-effective servicing in the event removal and/or replacement of components of the ducting arrangement may be necessary.

As may be appreciated in FIG. 16, in one non-limiting embodiment the affixing connection 52 at the downstream side of the ducting arrangement may include means for pivotally connecting 81 the downstream side of the ducting arrangement to an exit piece. In one non-limiting embodiment, means for pivotally connecting 81 may comprise corresponding partly spheroidal surfaces (e.g., not a full spheroidal), such as a partly spheroidal flange 82 of an exit piece configured to interface with a corresponding partly spheroidal spacer 84. See also FIG. 18. This arrangement is effective to provide certain swiveling (e.g., conical motion about the longitudinal axis of the ducting arrangement) degree of freedom to the ducting arrangement. Means for pivotally connecting 81 may further comprise a washer 86 with a conical surface configured to engage a corresponding conical surface on a spacer 88 arranged to provide an interference fit with respect to a flange 89 on metallic support frame 26. This conical surface arrangement is effective to reduce bending and shearing of the bolts 90 used in this connecting means.

In operation, disclosed embodiments reduce the amount of cooling air that may be needed to cool the transition duct system. This improves the efficiency of the gas turbine engine and can lead to reduced generation of NOx emissions. Disclosed embodiments are effective to securely attach a thermal insulating liner, such as may comprise a suitable ceramic, in the presence of a substantial flow path pressure, as may develop in the high Mach (M) number regions of the system. Moreover, disclosed embodiments effectively accommodate thermal growth differences that may develop between the thermal insulating liner and a metal outer shell onto which the liner is disposed.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A ducting arrangement for a combustion turbine engine, the ducting arrangement comprising:

a ceramic liner defining a hot gas path throughout a length of the ducting arrangement;

a cooling sleeve disposed circumferentially outwardly onto the ceramic liner along the length; and a metallic support frame disposed circumferentially outwardly onto the cooling sleeve along the length, wherein the cooling sleeve is structured along the length with means for biasing against the ceramic liner and the metallic support frame to resiliently accept mechanical and thermal growth induced loading that develops between the ceramic liner and the metallic support frame during operating conditions of the combustion turbine engine.

2. The ducting arrangement of claim 1, wherein the cooling sleeve is a structure selected from the group consisting of a metallic sheet structure, a mesh structure, and a woven mesh structure.

3. The ducting arrangement of claim 2, wherein a surface of the metallic sheet structure includes features that constitute the means for biasing against the ceramic liner and the metallic support frame.

4. The ducting arrangement of claim 3, wherein the features are selected from the group consisting of a plurality of waves having a crest configured to form a wave spring having a desired spring constant, a plurality of waves arranged to form a sinusoidal wave spring, a plurality of waves with orifices arranged to form a segmented wave spring; a sinusoidal wave spring, a wave spring with cooling orifices; a wave spring with transversely-extending cooling slots, a plurality of dimples, a plurality of dimples spatially offset relative to one another, and a combination of two or more of said features.

5. The ducting arrangement of claim 2, wherein a spring constant of the mesh structure or the woven mesh structure characterizes the means for biasing against the ceramic liner and the metallic support frame.

6. The ducting arrangement of claim 1, wherein the cooling sleeve comprises a metallic sheet structure including slits extending lengthwise throughout the ducting arrangement to convey cooling air to the ceramic liner and the metallic support frame.

7. The ducting arrangement of claim 6, wherein the metallic support frame comprises respective cooling air inlet orifices arranged in correspondence with respective ones of the slits to pass cooling air to the slits in the cooling sleeve.

8. The ducting arrangement of claim 2, wherein the metallic support frame comprises respective cooling air inlet orifices in fluid communication with the mesh structure or the woven mesh structure.

9. The ducting arrangement of claim 1, further comprising interference fit means for affixing to one another the ceramic liner, the biasing sleeve and the metallic support frame at an upstream side of the ducting arrangement.

10. The ducting arrangement of claim 9, wherein the interference fit means comprises a clamping ring including an end segment with a tapering profile in correspondence with an opposed tapering ring profile at an end segment of the ceramic liner.

11. The ducting arrangement of claim 10, wherein the interference fit means further comprises a liner protective ring interposed between the corresponding end segments of the clamping ring and the ceramic liner, the liner protective ring including an appendage to engage a segment of the ceramic liner axially extending downstream from the end segment of the ceramic liner.

12. The ducting arrangement of claim 10, wherein the clamping ring is responsive to a positioning assembly arranged to cause downstream axial movement of the clamping ring relative to the ceramic liner so that the corresponding tapering profiles of the clamping ring and the ceramic liner engage define an interference fit between one another.

13. The ducting arrangement of claim 9, further comprising means for pivotally connecting a downstream side of the ducting arrangement to an exit piece.

14. The ducting arrangement of claim 1, comprising a cylindrical segment extending from an upstream side of the ducting arrangement to a location between the upstream side and a downstream side of the ducting arrangement.

15. The ducting arrangement of claim 14, further comprising a flow-accelerating structure extending from the location between the upstream side and the downstream side of the ducting arrangement to the downstream side of the ducting arrangement.

16. The ducting arrangement of claim 1, wherein the ceramic liner is a structure selected from the group consisting of ceramic matrix composite, and a thermal barrier coating.

17. A combustion turbine engine comprising:

a ducting arrangement having an upstream side fluidly coupled to receive a flow of high-temperature combustion gases from a combustor outlet, the ducting arrangement having a downstream side fluidly coupled to convey the flow of high-temperature combustion gases to an exit piece, the ducting arrangement comprising:

a thermal insulating liner defining a hot gas path throughout a length of the ducting arrangement;

a cooling sleeve disposed circumferentially outwardly onto the thermal insulating liner along the length; and a metallic support frame disposed circumferentially outwardly onto the cooling sleeve along the length, wherein the cooling sleeve comprises a biasing structure along the length to engage the thermal insulating liner and the metallic support frame to resiliently accept mechanical and thermal growth induced loading that develops between the thermal insulating liner and the metallic support frame during operating conditions of the combustion turbine engine.

18. The ducting arrangement of claim 17, wherein the cooling sleeve is a structure selected from the group consisting of a metallic sheet structure, a mesh structure, and a woven mesh structure.

19. The ducting arrangement of claim 17, further comprising an interference fit assembly arranged to affix to one another the thermal insulating liner, the biasing sleeve and the metallic support frame at an upstream side of the ducting arrangement.

20. The ducting arrangement of claim 17, wherein the thermal insulating liner is a structure selected from the group consisting of a ceramic, a ceramic matrix composite, and a thermal barrier coating.

* * * * *